US007789250B2

(12) United States Patent
Aamodt

(10) Patent No.: US 7,789,250 B2
(45) Date of Patent: Sep. 7, 2010

(54) ATHLETIC BALL ORGANIZER

(76) Inventor: Robert W. Aamodt, 7685 Chancellor Dr., Colorado Springs, CO (US) 80920

( * ) Notice: Subject to any disclaimer, the term of this patent is extended or adjusted under 35 U.S.C. 154(b) by 384 days.

(21) Appl. No.: 11/874,485

(22) Filed: Oct. 18, 2007

(65) Prior Publication Data

US 2008/0099415 A1 May 1, 2008

Related U.S. Application Data

(60) Provisional application No. 60/863,560, filed on Oct. 30, 2006.

(51) Int. Cl.
*A47F 5/08* (2006.01)

(52) U.S. Cl. ..... 211/118; 211/14; D6/552

(58) Field of Classification Search ..... 211/86.01, 211/14, 118, 113, 30, 85.3; 206/315.9, 583, 206/807; 248/311.2, 205.2, 317; D6/552
See application file for complete search history.

(56) References Cited

U.S. PATENT DOCUMENTS 1,896,446 A * 2/1933 Goeller ..... 403/57
3,063,570 A * 11/1962 Kroner ..... 211/113
3,669,276 A * 6/1972 Woods ..... 211/34
4,119,247 A * 10/1978 Newquist et al. ..... 224/191
4,214,684 A 7/1980 Galowitz
4,329,789 A * 5/1982 Erickson ..... 34/195
4,826,177 A * 5/1989 Ponte ..... 273/400
5,232,101 A * 8/1993 Shaftner et al. ..... 211/14
5,542,530 A * 8/1996 Freelander ..... 206/292
5,622,346 A * 4/1997 Story, Jr. ..... 248/311.2
D389,688 S * 1/1998 Iacono ..... D6/552
5,762,205 A * 6/1998 Davitz ..... 211/13.1
5,813,548 A * 9/1998 Jiang ..... 211/85.4
5,823,360 A * 10/1998 Gorosave ..... 211/13.1
5,894,951 A 4/1999 Hunt
5,988,433 A 11/1999 Crum
6,029,830 A * 2/2000 Manookian ..... 211/87.01
6,158,593 A * 12/2000 Olsen ..... 211/14
6,267,461 B1 7/2001 Dunagan
6,308,837 B1 * 10/2001 Bragg et al. ..... 211/13.1
6,530,489 B1 * 3/2003 Van Horn et al. ..... 211/113
7,275,669 B1 * 10/2007 Aikens ..... 224/420
2005/0006322 A1 * 1/2005 Kershaw ..... 211/14
2006/0049124 A1 * 3/2006 Wang ..... 211/113
2006/0124562 A1 6/2006 Kurcheski
2006/0207952 A1 * 9/2006 Timmons ..... 211/85.3
2009/0184077 A1 * 7/2009 Curet et al. ..... 211/117
2009/0189044 A1 * 7/2009 Mullin ..... 248/317

OTHER PUBLICATIONS

Search results from Amazon.com (Nov. 2006).

* cited by examiner

*Primary Examiner*—Darnell M Jayne
*Assistant Examiner*—Andres Gallego
(74) *Attorney, Agent, or Firm*—Marsh Fischmann & Breyfogle LLP

(57) ABSTRACT

An athletic ball organizer and a method for storing athletic balls. The athletic ball organizer includes a plurality of ball cradles that are adapted to retain an athletic ball. The organizer is adapted to be hung in a vertical orientation using support straps, whereby the ball cradles are vertically spaced-apart. This enables a user to remove an athletic ball from the organizer without moving an adjacent ball, and to replace the athletic ball in a similar fashion.

18 Claims, 5 Drawing Sheets

ATHLETIC BALL ORGANIZER

CROSS-REFERENCE TO RELATED APPLICATIONS

This application claims priority to U.S. Provisional Patent Application Ser. No. 60/863,560, filed Oct. 30, 2006, the disclosure of which is incorporated herein by reference in its entirety.

BACKGROUND OF THE INVENTION

1. Field of the Invention

The present invention relates to an athletic ball organizer that enables athletic balls having a variety of sizes and shapes to be organized, displayed or stored.

2. Description of Related Art

Many sports and other recreational activities utilize a ball as a part of the game, and different sports and recreational games utilize balls of varying sizes and shapes. For example, basketballs, volleyballs and kickballs are all spherical in shape but have different sizes. Other sports such as football and rugby utilize balls that are not spherical in shape. One challenge experienced by homeowners and athletic facilities is that balls having a variety of shapes and sizes must be stored in a convenient and accessible manner when not in use.

U.S. Pat. No. 4,214,684 by Galowitz discloses a rack for holding a plurality of balls in a compact array. The device is particularly useful for the storage and transport of bocce balls.

U.S. Pat. No. 5,232,101 by Shaftner et al. discloses a sports ball storage device that is adapted to be mounted on a pole or other structural member for containing at least one sports ball when the ball is not in use.

U.S. Pat. No. 5,894,951 by Hunt discloses a basketball storage device that is also adapted to be mounted to a pole or other support member, such as a pole supporting a basketball net.

U.S. Pat. No. 5,988,433 by Crum discloses a cylindrical storage unit adapted to contain sport balls where the balls are completely enclosed within the storage unit.

U.S. Pat. No. 6,267,461 by Dunagan et al. also discloses a ball storage apparatus for storing a sports ball. The device is adapted to be mounted on a pole or support member such as a pole supporting a basketball net.

U.S. Patent Publication No. 2006/0124562 by Simonetta Kurcheski discloses a mountable ball holder that mounts to a support structure to receive and retain a single athletic ball.

There are several problems associated with these and other devices for the storage of balls. For example, structurally rigid devices occupy a significant volume of space even when the device is not being utilized to store balls. Some of these devices are rigidly mounted into position and require the use of tools to move the device from one location to another. Further, many of these devices are not able to accommodate balls of different shapes and sizes, such as may be necessary in a home garage. In addition, many of these devices require the removal of one or more unwanted balls from the device in order to access a desired ball that is disposed within the device.

SUMMARY OF THE INVENTION

The athletic ball organizer of the present invention allows athletic balls and similar items to be organized, displayed or stored such that the balls can be readily accessed. The organizer includes a plurality of ball cradles that are adapted to retain various athletic balls ranging in diameter and shape.

The ball cradles can be vertically spaced-apart so that a ball retained in the organizer is not directly supported by a ball beneath it. This allows a user to organize, display or store their collection of balls by placing each ball into a cradle. The user can thereby remove any ball of choice without the necessity of removing any of their remaining balls and can replace the same ball in a like fashion. Further, the organizer prevents balls that are retained by the organizer from exerting pressure on balls disposed beneath them, which can deform the balls over time. The device can be mounted above ground level to a vertical, vertically angled, horizontal or horizontally angled surface or apparatus for unrestricted user placement. When mounted to a surface or apparatus that allows the device to hang in an unobstructed manner, such as from a ceiling, the user advantageously has access to their balls from either the front or back of the device.

The organizer can be constructed using flexible materials such as textiles, including synthetic polymers, or malleable plastics to allow the ball cradles to conform to the balls being placed in the device and reduce the chance of damage to the ball by eliminating rigidity.

According to one embodiment, an athletic ball organizer is provided. The athletic ball organizer is adapted to be mounted in a substantially vertical orientation to retain a plurality of athletic balls. The athletic ball organizer includes a plurality of ball cradles that are disposed in vertically spaced-apart relation between two support straps, whereby an athletic ball can be removed from a ball cradle without disturbing an adjacent athletic ball within the organizer.

According to one aspect, the ball organizer includes at least three ball cradles and in another aspect includes at least five ball cradles.

According to another aspect, the ball cradles include at least two ball cradle bands that extend between and are attached to the support straps. The ball cradle bands can be spaced-apart at a central portion of the bands to form a closed loop that is adapted to retain an athletic ball. The cradle bands can also be disposed at a downward angle relative to the support straps that is greater than 90° (e.g., not perpendicular) to better secure an athletic ball.

According to another aspect, the athletic ball organizer includes means for mounting the athletic ball organizer in a substantially vertical orientation. In one embodiment, the athletic ball organizer can include apertures that are disposed near the top of the support straps, such that the apertures can be secured to mounting hooks or a similar mounting device.

According to another aspect, the athletic ball organizer can include a horizontal retaining member that is disposed above the ball cradles and connects the support straps. The horizontal retaining member is adapted to retain the support straps in a substantially parallel spaced-apart relation when the athletic ball organizer is vertically mounted from the top of the support straps.

According to another aspect, at least one of the ball cradles is detachable from the support straps. For example, the ball cradles can be detached from and reattached to the support straps using hook and loop fasteners. The use of hook and loop fasteners can also advantageously enable the position of the ball cradles to be adjusted along the length of the support straps to better accommodate balls of various sizes and shapes.

According to another aspect, the ball cradles are fabricated from a flexible webbing material. The use of flexible webbing material will enable the ball cradles to conform and adapt to the size and shape of the variety of athletic balls without any long-term damage to the athletic balls. The support straps can also be fabricated from a similar flexible webbing material.

By constructing the organizer from flexible webbing or a similar material, the device can be easily collapsed and stored when not in use.

According to another aspect, the athletic ball organizer also includes a bag that is adapted to attach to the athletic ball organizer. The bag is adapted to contain other athletic equipment. For example, the bag can attach to the bottom of the organizer, such as by using hook and loop fasteners.

According to another aspect, the support straps are formed from two individual straps that are spaced-apart. Alternatively, the two support straps can be formed from a single continuous strap, such as where the organizer is mounted by hanging the organizer from the two ends of the continuous strap.

According to another embodiment, an athletic ball organizer is provided that includes a plurality of ball cradles, where the ball cradles include a first ball cradle band and a second ball cradle band that are connected at ends thereof and are spaced-apart at a central portion of the ball cradle bands to form a closed loop that is adapted to retain an athletic ball. The device also includes first and second elongate support straps where the ball cradle bands are attached to the first support strap and the second support strap, and are disposed in vertically spaced-apart relation between the support straps.

According to one aspect, the device also includes a horizontal retaining member disposed above the ball cradles and connecting the first and second support straps. The retaining member is adapted to maintain the support straps in substantially parallel spaced-apart relation when the organizer is vertically mounted.

According to another embodiment, a method for storing a plurality of athletic balls in vertically spaced-apart relation is provided. The method include providing a plurality of ball cradles disposed between two opposed support straps, and hanging the support straps in a substantially vertical orientation such that the ball cradles are disposed in vertically spaced-apart relation. Athletic balls are placed in one or more of the ball cradles, whereby an athletic ball can be removed from the ball cradle without moving or otherwise disturbing an athletic ball that is retained in an adjacent ball cradle.

DESCRIPTION OF THE INVENTION

Referring now to the attached figures, an athletic ball organizer and a method for storing athletic balls will be described in further detail.

Figure 1:
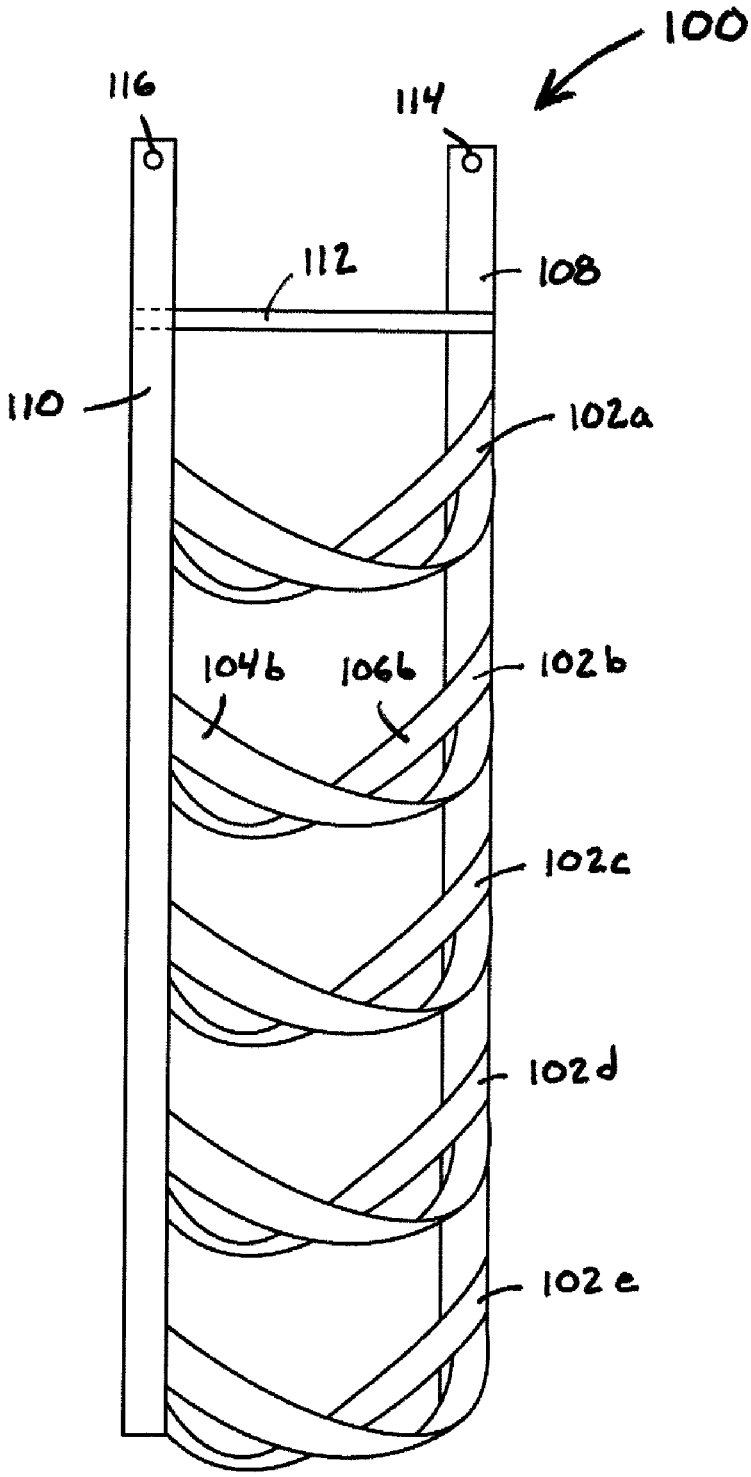
FIG. 1 illustrates a perspective view of an athletic ball organizer.

FIG. 1 illustrates a perspective view of an athletic ball organizer 100. Generally, the athletic ball organizer 100 includes a plurality of athletic ball cradles 102*a*-102*e* that are disposed in vertically spaced-apart relation when the organizer 100 is mounted in a vertical orientation for the storage and organization of athletic balls. The ball cradles are supported by opposed support straps 108 and 110.

The athletic ball cradles 102*a-e* are each adapted to retain an athletic ball that is placed within the ball cradle. In this regard, the athletic ball cradles can have any shape and be fabricated from any material that is capable of supporting and retaining an athletic ball. For example, the cradles can include a sheet of pliable material defining a concave surface for supporting and retaining an athletic ball therein such that the athletic ball cannot easily fall from the ball cradle. In this regard, the ball cradle can comprise netting or a mesh-like material into which the athletic ball can be placed.

In the embodiment illustrated in FIG. 1, the ball cradles 102*a-e* each include two ball cradle bands, such as bands 104*b* and 106*b*. The ball cradle bands extend between and are attached to the opposed support straps 108 and 110. The cradle bands are spaced-apart at a central portion of the bands to form a pliable closed loop that is adapted to support and retain an athletic ball by creating a cupping effect. This embodiment has the advantage that the ball cradle bands can extend outwardly from the plane of the support straps to conform to and secure an athletic ball placed within the ball cradle. The ball cradle bands can be elastic (i.e., stretchable) or can be static (i.e., non-stretchable). Useful materials can include woven or non-woven materials, such as natural fibers (e.g., cotton), leather, polymers such as polypropylene or other plastics, nylon and the like. The ball cradle bands are disposed between the support straps and can be attached to the inner surface of the support straps, as is illustrated in FIG. 1, or can be attached to the outer surface of the support straps. The ends of the ball cradle bands can be attached directly to each other, or the ends of the ball cradles can be individually attached to the support straps.

Although illustrated in FIG. 1 as being comprised of flat webbing material having a flat upper surface upon which the athletic ball can rest, the ball cradle bands can be comprised of other pliable materials, such as flexible rope or cord having a circular cross-section. However, webbing material having a flat surface upon which the athletic ball can be supported is preferred to provide increased stability, particularly for athletic balls having a non-spherical shape. Accordingly, the webbing material can have a top surface width of at least about 0.75 inches and more preferably at least about 1.5 inches.

In the embodiment illustrated in FIG. 1, the athletic ball organizer also includes a horizontal retaining member 112. The horizontal retaining member 112 is disposed in a position above the top-most ball cradle 102*a* to retain the support straps 108 and 110 in a substantially parallel spaced-apart relation when the athletic ball organizer is mounted. As discussed above with respect to the ball cradles, the horizontal retaining member can also be fabricated from elastic or static materials, including but not limited to woven or non-woven materials, such as natural fibers (e.g., cotton), leather, polymers such as polypropylene or other plastics, nylon and the like. The horizontal retaining member can also be fabricated from flat webbing material as is illustrated in FIG. 1 or from rope or cord having a circular cross-section.

The support straps 108 and 110 are adapted to be hung in a substantially vertical orientation such that the ball cradles are supported by and are vertically spaced-apart along the length of the support straps 108 and 110. As illustrated in FIG. 1, the support straps 108 and 110 comprise two individual support straps that are connected only by means of the ball cradles 102*a-e* and the horizontal retaining member 112. Alternatively, the two opposed support straps can be formed from a single continuous strap. For example, a continuous strap could be looped at the bottom of the organizer (i.e., below cradle 102*e*) with the two opposite ends of the strap being disposed at the top of the organizer (i.e., above retaining member 112). What is desired is that the organizer includes opposed support straps for supporting the ball cradles, whether they are two independent straps or are formed from a single looped strap.

Although illustrated in FIG. 1 as being disposed in substantially parallel relation, the support straps 108 and 110 can be disposed at a slight angle relative to each other. For example, if the lower ball cradle 102*e* is smaller than the upper ball cradle 102*a* then the distance between the support straps 108 and 110 at the bottom of the organizer will be smaller than the distance between the support straps at the top of the organizer. In this manner, smaller athletic balls could be stored in the bottom portion of the device while larger athletic balls are stored at the top of the device. However, it is preferred that the support straps are disposed in generally parallel spaced-apart relation along the length of the support straps that supports the ball cradles.

The organizer 100 can be vertically hung using mounting means, such as apertures 114 and 116. Alternatively, the organizer could be hung from loops formed by the ends of the support straps 108 and 110, by hooks placed at the end of the support straps, by hook and loop fasteners, or any other convenient means.

Figure 2:
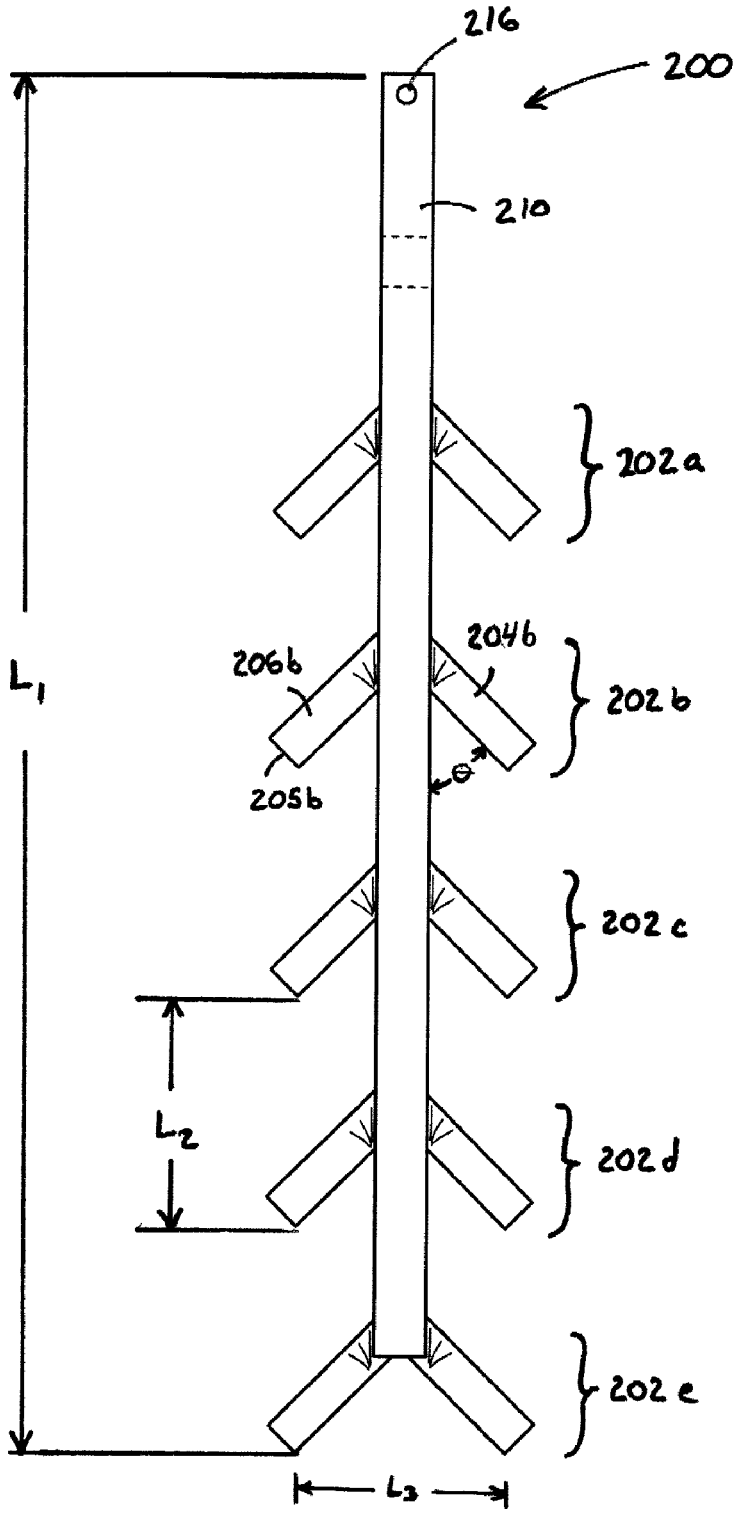
FIG. 2 illustrates a side view of an athletic ball organizer.

FIG. 2 illustrates a side view of an athletic ball organizer 200. Five ball cradles 202*a*-202*e* are disposed in vertically spaced-apart relation and are supported by a first support strap 210 and an opposed second support strap (not visible in FIG. 2).

Each ball cradle includes first and second ball cradle bands, such as ball cradle bands 204*b* and 206*b*. When the organizer 200 is vertically mounted, the ball cradle bands extend outwardly and in a downward direction with respect to the support straps. The cradle bands are placed at an angle (θ) relative to the support straps of greater than 0° and less than 90°, such as from about 10° to about 45°. In this manner, the ball cradle bands have two opposed surfaces upon which an athletic ball can be placed and supported. As is noted above, the ball cradle bands are preferably fabricated from a flexible material such as flexible webbing having a flat surface, such as flat surface 205*b*.

The organizer 200 can have a length that is sufficient to store a reasonable number of athletic balls, such as from about three athletic balls up to five or more athletic balls, while being hung in a vertical orientation. In this regard, it is preferred that the length of the organizer ($L_1$) be at least about 36 inches and not greater than about 72 inches. Further, the ball cradles are sufficiently spaced-apart along the support straps such that common athletic balls such as basketballs can be stored in the device without interfering with the storage of adjacent athletic balls. In this regard, the distance between adjacent ball cradles ($L_2$) is preferably at least about 8 inches and preferably is not greater than about 12 inches. Further, in order to accommodate a range of common athletic balls such as basketballs (circumference of about 30 inches) and volleyballs (circumference of about 26 inches), as well as footballs, the distance between the opposed surfaces of the cradle bands ($L_3$) is preferably at least about 3 inches and preferably is not greater than about 7 inches. Also, the distance between the opposed support straps where the ball cradles are supported is preferably at least about 8 inches and preferably is not greater than about 10 inches.

Figure 3:
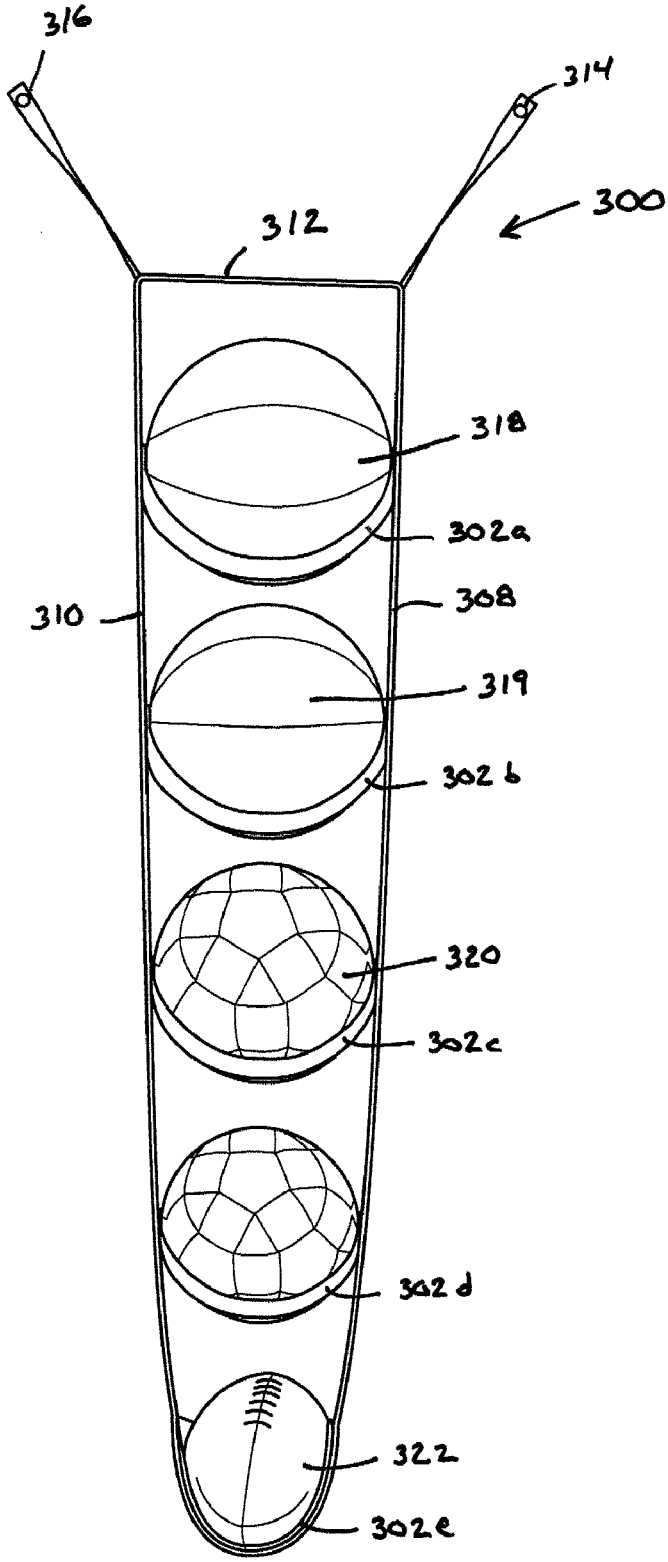
FIG. 3 illustrates a front view of an athletic ball organizer where a plurality of athletic balls of different sizes and shapes are retained by the organizer.

FIG. 3 illustrates an athletic ball organizer that is mounted in a substantially vertical orientation and has a plurality of athletic balls disposed within the ball organizer. As can be seen from FIG. 3, the athletic ball organizer 300 is adapted to support and retain a variety of athletic balls having different sizes and shapes. The organizer 300 includes mutually opposed support straps 308 and 310. A plurality of ball cradles 302*a*-*e* are disposed between and supported by the support straps 308 and 310 and are vertically spaced-apart such that one athletic ball (e.g., ball 318) does not rest upon another adjacent athletic ball (e.g., ball 319). The athletic balls that can be supported and retained include, but are not limited to, inflatable spherical balls such as basketballs 318, volleyballs 320, and kickballs, as well as oblong balls such as American footballs 322, rugby balls and the like. Thus, it is an advantage that a single athletic ball organizer can support and retain athletic balls having a wide variety of sizes and shapes.

The athletic ball organizer 300 is mounted in a vertical orientation using apertures 314 and 316. A horizontal retaining member 312 advantageously retains the support straps 308 and 310 in a substantially parallel relation, even when the mounting points of the device (e.g., apertures 314 and 316) are spread apart farther than the distance between the support straps 308 and 310. Nonetheless, the organizer can also be hung from a single mounting point, or two mounting points that are spaced closer together.

Figure 4:
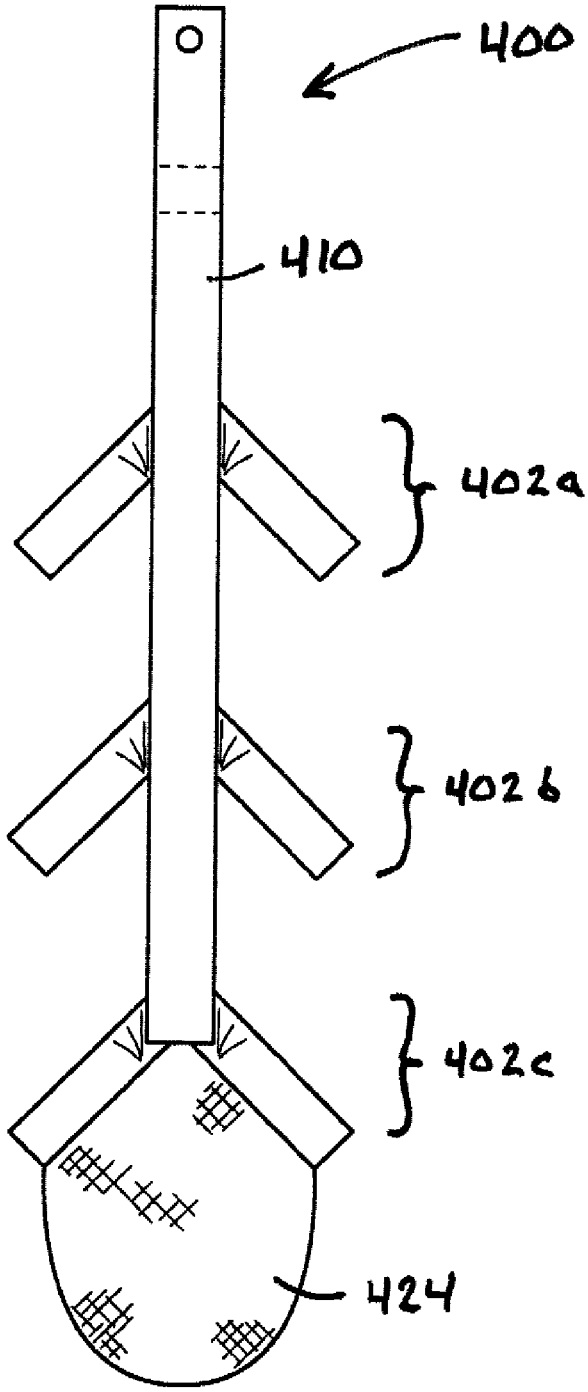
FIG. 4 illustrates an athletic ball organizer that includes a bag attached to the bottom of the organizer.

FIG. 4 illustrates an athletic ball organizer 400 that includes three ball cradles 402*a*-*c* disposed in vertically spaced-apart relation between a first support strap 410 and a second support strap (not visible in FIG. 4). In this embodiment, a bag 424 is attached to the athletic ball organizer. The bag 424 illustrated in FIG. 4 is attached to a bottom portion of the athletic ball organizer 400 and is adapted to contain additional athletic equipment within the bag. For example, gloves, smaller balls such as baseballs, or other pieces of athletic equipment that are not able to be supported by the ball cradles 402*a*-*c* can be placed within the bag 424. In this manner, a user can advantageously keep a variety of athletic equipment stored in one location for easy access and use. The bag 424 can be fabricated from materials such as netting or mesh, for example.

Figure 5:
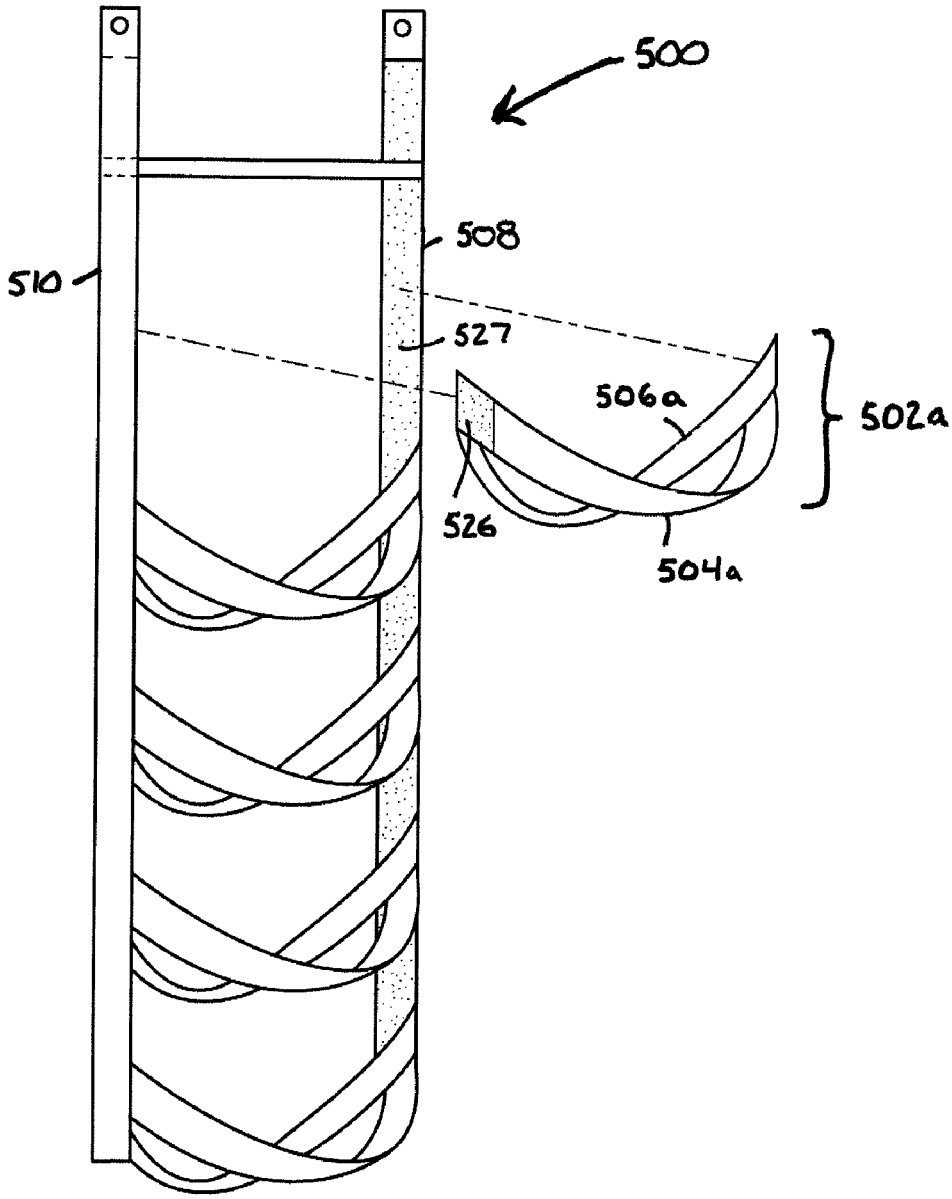
FIG. 5 illustrates a perspective view of an athletic ball organizer, where at least one of the ball cradles is detachable from the device.

FIG. 5 illustrates an athletic ball organizer 500 wherein one or more of the ball cradles are detachable and removable from the support straps. The athletic ball organizer 500 includes a plurality of ball cradles, including ball cradle 502*a*. Ball cradle 502*a* is comprised of ball cradle bands 504*a* and 506*a*. The ball cradle bands form a closed loop that is adapted to retain an athletic ball within the ball cradle 502*a*. It will be appreciated that the ball cradle bands 504*a* and 506*a* can be connected at opposite ends thereof to form a closed loop by attaching to each other, or by forming a closed loop when the ball cradle bands are placed between and are attached to the support straps 508 and 510. That is, the ball cradles can comprise two independent ball cradle bands or can comprise two ball cradle bands that are permanently or removably attached to each other, such as by stitching. Alternatively, the ball cradle bands can be fabricated from a single, unitary piece of material, such as a pliable plastic material.

In the embodiment illustrated in FIG. 5, the vertical distance between the ball cradles can advantageously be adjusted by the use of hook and loop fasteners. For example, the athletic ball cradle 502*a* can include the hook portion 526 of a hook and loop fastener at the distal ends of the cradle. Likewise, the inner surface of the support bands can include the loop portion 527 of a hook and loop fastener such that the ball cradles can be attached to the support straps. If a portion of the hook and loop fastener is provided along the length of the support straps, the position of the ball cradles can be fully adjustable along the length of the support straps.

Thus, the athletic ball organizer described herein allows athletic balls and similar items to be organized, displayed or stored such that they can be readily accessed. The ball cradles permit an athletic ball to be retained in the organizer such that it is not directly supported by a ball beneath it. This allows a user to organize, display or store their collection of balls by placing each ball into a cradle. The user can thereby remove any ball of choice without the necessity of removing any of their remaining balls and can replace the same ball in a like fashion.

Further, the organizer can be fabricated from pliable materials, such as flexible webbing, enabling the organizer to be easily stored when not in use and to be easily moved from one location to another.

While various embodiments of the present invention have been described in detail, it is apparent that modifications and adaptations of those embodiments will occur to those skilled in the art. However, is to be expressly understood that such modifications and adaptations are within the spirit and scope of the present invention.

What is claimed is:

1. An athletic ball organizer adapted to be mounted in a substantially vertical orientation and to retain a plurality of athletic balls, the athletic ball organizer comprising:

two elongate support straps disposed in horizontally spaced-apart relation;

a plurality of ball cradles that are supported in a vertically spaced-apart relation by said two support straps, wherein each of the plurality of ball cradles consist of two ball cradle bands made of flexible webbing having a flat surface and forming a closed loop whereby an athletic ball is capable of being removed from a ball cradle without disturbing an adjacent athletic ball within the organizer.

2. The athletic ball organizer recited in claim 1, wherein said ball organizer comprises at least three of said ball cradles.

3. The athletic ball organizer recited in claim 1, wherein the ball cradle bands are spaced-apart at a central portion of the ball cradle bands to form said closed loop that is adapted to retain an athletic ball.

4. The athletic ball organizer recited in claim 1, further comprising means for mounting said athletic ball organizer in a substantially vertical orientation.

5. The athletic ball organizer recited in claim 4, wherein said mounting means comprises apertures disposed near a top edge of said support straps.

6. The athletic ball organizer recited in claim 1, wherein said athletic ball organizer further comprises a horizontal retaining member disposed above said ball cradles and connecting said support straps, said retaining member being adapted to retain said support straps in a substantially parallel spaced-apart relation when said athletic ball organizer is mounted in a substantially vertical orientation.

7. An athletic ball organizer as recited in claim 1, wherein at least one of said plurality of ball cradles is detachable from said support straps.

8. An athletic ball organizer as recited in claim 5, wherein said at least one of said ball cradles is detachable from said support straps using hook and loop fasteners.

9. The athletic ball organizer recited in claim 1, wherein said support straps comprise flexible webbing.

10. The athletic ball organizer recited in claim 1, wherein said two support straps comprise two individual support straps.

11. The athletic ball organizer recited in claim 1, wherein said two support straps are formed from a single looped strap.

12. An athletic ball organizer, comprising an elongate first support strap; and an elongate second support strap opposed from said first support strap;

a plurality of ball cradles, wherein said ball cradles consist of a first ball cradle band and a second ball cradle band that are connected at ends thereof, such that said first and second ball cradle bands are disposed between the first and second support straps and are attached to surfaces of the first and second support straps, and are spaced apart at a central portion of said ball cradles to form a pliable closed loop that is adapted to retain an athletic ball;

an elongate first support strap; and an elongate second support strap opposed from said first support strap, wherein said ball cradle bands are supported in a vertically spaced-apart relation by the first and second support straps.

13. The athletic ball organizer recited in claim 12, further comprising a horizontal retaining member disposed above said ball cradles and connecting said first support strap and said second support strap, said retaining member being adapted to maintain said support straps in substantially parallel spaced-apart relation when said organizer is mounted in a substantially vertical orientation.

14. The athletic ball organizer recited in claim 12, wherein said cradle bands comprise flexible webbing.

15. The athletic ball organizer recited in claim 12, wherein said first and second support straps comprise flexible webbing.

16. The athletic ball organizer recited in claim 15, wherein said retaining member comprises flexible webbing.

17. The athletic ball organizer recited in claim 1, wherein said flat surface of said flexible webbing has a width of at least about 0.75 inches.

18. The athletic ball organizer of claim 12, wherein the ball cradle bands are disposed at a downward angle relative to the support straps.

* * * * *